US008776557B2

(12) United States Patent
Wang

(10) Patent No.: US 8,776,557 B2
(45) Date of Patent: Jul. 15, 2014

(54) HIDDEN SHACKLE LOCK WITH AN INTERCHANGEABLE CORE

(75) Inventor: Wei Kai Wang, Zhejiang (CN)

(73) Assignee: Pacific Lock Company, Valencia, CA (US)

( * ) Notice: Subject to any disclaimer, the term of this patent is extended or adjusted under 35 U.S.C. 154(b) by 1657 days.

(21) Appl. No.: 11/907,150

(22) Filed: Oct. 10, 2007

(65) Prior Publication Data

US 2008/0105005 A1 May 8, 2008

Related U.S. Application Data

(60) Provisional application No. 60/857,190, filed on Nov. 7, 2006.

(51) Int. Cl.
*E05B 67/36* (2006.01)

(52) U.S. Cl.
USPC ..... 70/34; 70/14; 70/371

(58) Field of Classification Search
USPC ..... 70/6, 14, 32, 33, 34, 51, 52, 370, 371, 70/379 R, 416, 451
See application file for complete search history.

(56) References Cited

U.S. PATENT DOCUMENTS

| | | | | |
|---|---|---|---|---|
| 3,404,549 | A | 10/1968 | Best | |
| 3,817,062 | A | 6/1974 | Randel | |
| 3,820,360 | A | 6/1974 | Best | |
| 4,075,878 | A * | 2/1978 | Best | 70/371 |
| 4,345,448 | A * | 8/1982 | Solomon | 70/95 |
| 4,444,034 | A * | 4/1984 | Best et al. | 70/371 |
| 4,672,828 | A | 6/1987 | Theriault | |
| 4,793,166 | A | 12/1988 | Marks | |
| 5,127,244 | A | 7/1992 | Myers | |
| D336,030 | S | 6/1993 | Falk et al. | |
| 5,233,851 | A | 8/1993 | Florian | |
| 5,345,794 | A | 9/1994 | Jenks | |
| 5,398,531 | A * | 3/1995 | Shen | 70/371 |
| 5,873,272 | A * | 2/1999 | Thompson | 70/371 |

(Continued)

OTHER PUBLICATIONS

Johnson, Gale, Xperinetix Has a Better Idea, The Locksmith Ledger, Dec. 2000, 5 pages, San Diego, CA.
Letter from Mr. John Ulaszek to Mr. Gregory Waugh, President of Pacific Lock Company, the Assignee of the current application, 3 pages, Jan. 22, 2007.
Letter from Mr. John Ulaszek to Mr. Gregory Waugh, President of Pacific Lock Company, the Assignee of the current application, 3 pages, Feb. 9, 2007.

(Continued)

*Primary Examiner* — Christopher Boswell
(74) *Attorney, Agent, or Firm* — Patent Law Agency, LLC; Peter Ganjian

(57) ABSTRACT

A hidden shackle style lock is disclosed. The lock includes a substantially cylindrical housing having a top surface, a bottom surface, and a curved side surface. The lock also includes a first cavity on the bottom surface of the housing extending part way along a thickness of the housing, and a second cavity on the side surface intersecting with the first cavity. A hollow sleeve is slidably attached within the second cavity. The sleeve includes a first end face, a second end face, and a third cavity. The third cavity extends from the first end face to the second face and is substantially coaxial with the second cavity. A shackle having a first end and a second end is fixedly coupled to the first end face of the sleeve. The lock also includes an interchangeable core having a first locking mechanism and a second locking mechanism lockingly disposed within the third cavity, and coupled to the straight shackle. The interchangeable core is configured to operate the first locking mechanism to rotate the shackle, and operate the second locking mechanism to unlock the interchangeable core from the third cavity.

23 Claims, 2 Drawing Sheets

(56) References Cited

U.S. PATENT DOCUMENTS

| | | | | |
|---|---|---|---|---|
| 6,109,080 | A | 8/2000 | Chen et al. | |
| 6,338,261 | B1 | 1/2002 | Liu | |
| 6,467,317 | B1 * | 10/2002 | Hillabush et al. | 70/56 |
| 6,606,890 | B1 | 8/2003 | Widen | |
| 6,634,196 | B2 | 10/2003 | Huang | |
| 6,758,075 | B1 * | 7/2004 | Thwing | 70/379 R |
| 6,883,356 | B1 * | 4/2005 | Wu | 70/379 R |
| RE38,832 | E | 10/2005 | Thwing | |
| 6,981,396 | B1 * | 1/2006 | Kim | 70/371 |
| 2005/0199027 | A1 | 9/2005 | Mannella | |
| 2005/0252257 | A1 | 11/2005 | Woods et al. | |

OTHER PUBLICATIONS

Provisional application cover sheet for U.S. Appl. No. 60/220,416, filed Jul. 24, 2000 and an attached page with a figure.

Security Padlock Uses IC Core Cylinders, Gale Johnson, Locksmith Ledger, vol. 60, No. 13 (4 pages).

Pacific Lock, Gregory B. Waugh, The National Locksmith, Jan. 2006, 6 pages.

Pacific Lock Introduces the World's First Hockey-Pucks for SFIC's and KiK Cylinders, The National Locksmith, Jan. 2007, 6 pages.

Lynk, William M. "Interchangeable Cores Small Format," The National Locksmith, 2000, 44 pages.

* cited by examiner

HIDDEN SHACKLE LOCK WITH AN INTERCHANGEABLE CORE

CROSS REFERENCE TO RELATED APPLICATIONS

This application is based upon and claims the benefit of priority from U.S. Provisional Application No. 60/857,190 to Wei Wang filed on Nov. 7, 2006, the entire contents of which are incorporated herein by reference.

TECHNICAL FIELD

The present disclosure relates to a hidden shackle style lock, and more particularly to a hidden shackle style lock with an interchangeable core.

BACKGROUND

In a common locking device, such as an exposed shackle type padlock (hereinafter referred to as a 'padlock'), a U-shaped hinged shackle is passed through one or more rings (or through-holes), and the free end of the shackle inserted and retained in a bore on the housing of the padlock. The rings are now said to be locked using the padlock. An operator key is used to operate (lock and unlock) the locking device. The exposed shackle type padlock includes a central cylinder which turns an attached cam. This cam engages with a groove on the shackle, locking the padlock. Such a padlock also contains a set of locking pins that prevent a wrong key from operating the padlock. When the cylinder is rotated one way using an operator key, the cam moves to disengage the shackle, allowing the shackle to be lifted and rotated, thereby unlocking the exposed shackle type padlock. Since a unique operator key controls the operation of the exposed shackle type padlock, losing or misplacing the operator key will typically involve replacement of the padlock.

To save time and money associated with the replacement of the padlock, when the operator key is lost, an interchangeable core is commonly used with padlocks. The interchangeable core, first invented by Frank Best in 1912, has become the most commonly available type of interchangeable core cylinder, and is easily recognizable by the 'figure-8' shape of the core's face. This type of interchangeable core is now standardized and is offered by many commercial lock manufacturers. Competition in the market place has decreased the cost and increased the availability of these interchangeable cores, making them well suited for use with common locks. Since the interchangeable core contains the locking pins of the padlocks, the combination of the interchangeable core and an operator key controls the operation of these padlocks. In such exposed shackle type padlocks with an interchangeable core, a control key is used to remove the interchangeable core (with one combination) from the lock and replace it with a core having a different combination. A retaining tab that protrudes from the cylindrical surface of the interchangeable core engages with a cavity on the mating surface of the lock housing, locking the interchangeable core in the housing. With the interchangeable core locked in place in the housing, the operator key is used to control the operation of the padlock. This interchangeable core feature allows a locksmith to re-key a padlock in a matter of hours instead of a matter of weeks, if the operator key is misplaced.

In the padlock described earlier, the shackle is exposed, and therefore prone to attack (applying torque to the shackle, applying a tension force to the shackle, cutting the shackle, etc.). A hidden shackle style locking device (hereinafter referred to as a 'hockey puck lock') is sometimes used to prevent access to the shackle and thereby reduce such attack. A hockey puck lock has a generally stubby cylindrical shape with a rounded front and back surface. The rounded back surface defines a generally rectangular cavity to receive one or more parallel plates (which are to be locked together) with mating through-holes. A cylindrical shackle attached to a central cylinder having a locking mechanism is slidably disposed on the stubby cylindrical housing a retaining screw. The retaining screw permits the central cylinder and the shackle to freely slide in the housing, while preventing it from being detached from the housing. The shackle slides in the direction of its longitudinal axis, out of one wall of the rectangular cavity into a blind cylindrical cavity formed on the opposite wall of the rectangular cavity. To lock the parallel plates together within the rectangular cavity, the shackle passes through the mating through-holes of the parallel plates, while sliding from one wall of the rectangular cavity into the cylindrical cavity. When an operator key is inserted into the central cylinder and turned, notches on the side of the operator key operate a set of locking pins (as described earlier) on the central cylinder, and allow the central cylinder and the shackle to turn. When the shackle turns, a groove or a tab formed on the tip of the shackle engages with a corresponding geometry within the cylindrical cavity, thereby the locking the shackle in place.

While the typical hockey puck lock decreases the susceptibility of the locking device to attack, replacing the core involves a complex procedure that often justifies replacement of the entire locking device. Recall that, in a padlock, sliding the interchangeable core along its longitudinal axis allows the interchangeable core to slide out of the padlock housing for replacement. In a hockey puck lock, however, the locking operation requires the shackle (along with the attached central cylinder) to slide along its longitudinal axis into the cylindrical cavity before they lockingly engage. That is, if sliding along the longitudinal axis is utilized to remove the interchangeable core in a hockey puck lock, unlocking the lock may also cause the interchangeable core to be separated from the housing. Such frequent removal of the interchangeable core from the housing may be undesirable since the cores may be prone to loss or damage. Therefore, incorporating the interchangeable core concept of the padlock to the hockey puck lock, without causing the interchangeable core to be removed from the lock housing every time the lock is unlocked, is challenging.

U.S. Pat. No. 5,345,794 (the '794 patent) issued to Jenks on Sep. 13, 1994 describes a hockey puck lock (generally having structural details as described earlier) with a replaceable core. The replaceable core of the '794 patent is slidably retained within the lock housing by a locking pin. The protruding locking pin on an external surface of the replaceable core slides on an elongated slot on a mating surface of the housing, thereby retaining the replaceable core to the housing. To lock parallel plates with mating through holes using the lock of the '794 patent, the plates are positioned inside the rectangular cavity and the shackle attached to the replaceable core is slid through the mating through holes of the parallel plates and into the cylindrical cavity. While the replaceable core is in this locking position, an operator key causes the spring loaded locking pin to protrude into a pin recess located within the slot, thereby locking the shackle in position. To remove the replaceable core of the '794 patent from the housing, access holes are provided to manually depress the locking pin, by inserting a screw driver (or similar objects), while extracting the replaceable core from the housing.

While the hockey puck lock of the '794 patent enables replacement of the replaceable core when the operator key is lost, it may have some disadvantages. For example, the replaceable core of the '794 patent may be easily removed by an unauthorized person, thereby increasing the potential for loss, and increased replacement costs. In addition, in situations where the access holes can be accessed while the lock is in the locked position, the lock may be unlocked by depressing the locking pin through an access hole.

The present disclosure may overcome one or more of the shortcomings set forth above. The hockey puck lock of the current disclosure utilizes novel design features to retain the benefits of conventional hockey puck locks, while enabling the convenience of using commonly available interchangeable cores.

SUMMARY OF THE INVENTION

In one aspect, a hidden shackle style lock is disclosed. The lock includes a substantially cylindrical housing having a top surface, a bottom surface, and a curved side surface. The lock also includes a first cavity on the bottom surface of the housing extending part way along a thickness of the housing, and a second cavity on the side surface intersecting with the first cavity. A hollow sleeve is slidably attached within the second cavity. The sleeve includes a first end face, a second end face, and a third cavity. The third cavity extends from the first end face to the second face and is substantially coaxial with the second cavity. A shackle having a first end and a second end is fixedly coupled to the first end face of the sleeve. The lock also includes an interchangeable core having a first locking mechanism and a second locking mechanism lockingly disposed within the third cavity, and coupled to the straight shackle. The interchangeable core is configured to operate the first locking mechanism to rotate the shackle, and operate the second locking mechanism to unlock the interchangeable core from the third cavity.

In another aspect, the current disclosure discloses a method of using a hidden shackle style lock with an interchangeable core. The method includes, slidably attaching a hollow sleeve within a first cavity of a housing of the lock, fixedly coupling a shackle having a first locking feature to the sleeve, and inserting an interchangeable core including a first locking mechanism and a second locking mechanism within a central cavity of the hollow sleeve. The method also includes operating the first locking mechanism to lockably attach the interchangeable core to the sleeve, sliding the shackle across an exposed second cavity, and operating the second locking mechanism to engage the first locking feature.

In yet another aspect, a locking device is disclosed. The locking device includes a housing having a first cavity and a second cavity, where the first cavity perpendicularly intersects the second cavity. The locking device also includes a hollow sleeve slidably disposed within the second cavity. The sleeve includes a third cavity substantially coaxial with the second cavity. A shackle is fixedly coupled to the sleeve such that the shackle is configured to slide across the first cavity. The locking device also includes an interchangeable core lockingly disposed within the third cavity and coupled to the shackle. The interchangeable core is lockingly disposed by operating a first locking mechanism of the interchangeable core using a key.

DETAILED DESCRIPTION

Figure 1:
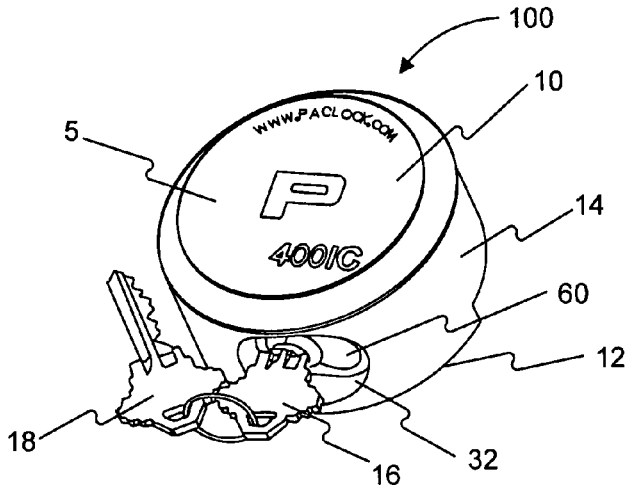
FIG. 1 is a diagrammatic illustration of an exemplary disclosed hidden shackle style lock.

FIG. 1 illustrates a hidden shackle style lock (locking device 100). The locking device 100 comprises a housing 5 having a generally circular cross-section with a generally circular front portion 10, a generally circular back portion 12, and a generally cylindrical side surface 14. It is also contemplated that the front portion 10, the back portion 12, and the side surface 14 may have other shapes. The front portion 10 and the back portion 12 may be planar or may be made up of multiple planar surfaces. The side surface 14 of the locking device 100 may include a side cavity 32 to insert the locking mechanism of the locking device 100. In some embodiments, the cross-section of the side cavity 32 (along a plane perpendicular to the front portion 10) has a rounded rectangular shape. However, the cross-section of the side cavity 32 may have other shapes, such as a square or an oval shape. One or more keys may also accompany the locking device 100. These keys may include an operator key 16 and a control key 18. The operator key 16 may be used to lock and unlock the locking device 100, and, as will be described in more detail below, the control key 18 may be used to lock and unlock an interchangeable core 60 from the locking device 100. It is contemplated that, in some embodiments, the same key may perform the functions of both the operator key 16 and the control key 18.

Figure 2:
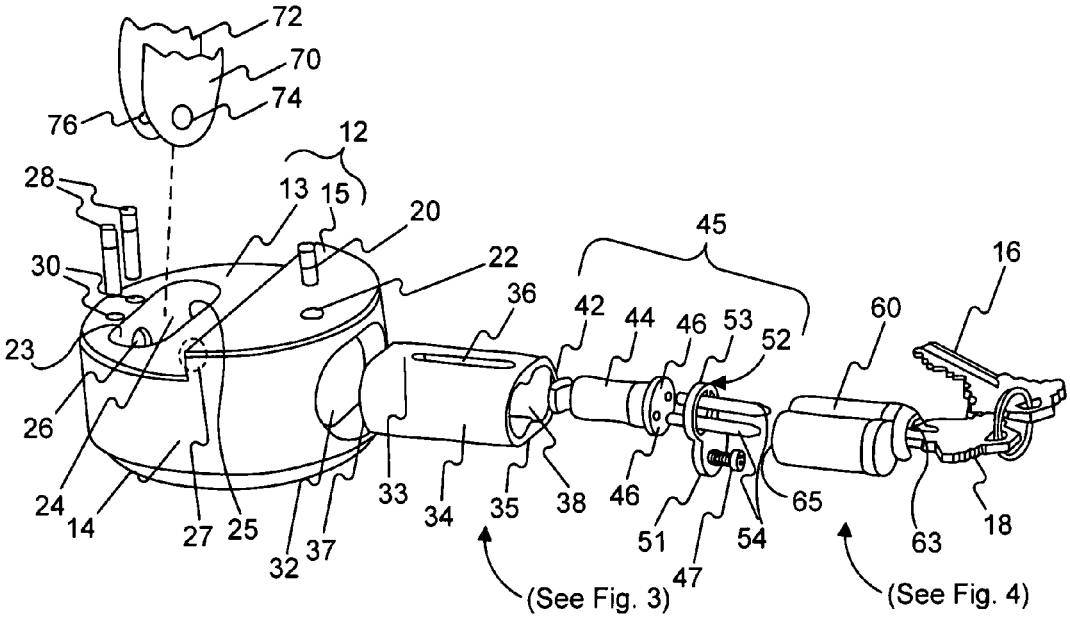
FIG. 2 is a diagrammatic illustration of exemplary components of the hidden shackle style lock of FIG. 1.

FIG. 2 illustrates the components that make up the locking system 100. The circular back portion 12 of the locking system 100 may be made of two planar surfaces—a first semi-circular portion 13 and a second semi-circular portion 15. In some embodiments, the first semi-circular portion 13 may be offset from the second semi-circular portion 15. It is contemplated that the back portion 12 may be made of one planar surface. It is also contemplated that the first semi-circular portion 13 and a second semi-circular portion 15 may have other shapes. The first semi-circular portion 13 may include a blind cavity 24. The blind cavity 24 may extend for a significant thickness of the locking device 100, but may not extend all the way to the front portion 10. The cross-section (along a plane parallel to the front portion 10) of the blind cavity 24 may be of a generally rectangular shape with rounded sides and edges. In some embodiments, the blind cavity 24 may be of another shape, such as a square, an oval, an elongated oval, or any other shape. The blind cavity 24 may have a first internal side wall 23 and a second internal side wall 25 which is opposite to the first internal side wall 23. The first internal side wall may include a first cavity 26, and the second internal side wall 25 may include a second cavity 27. In one embodiment, the first cavity 26 may not protrude through the side surface 14 of the locking device 100. The first cavity 26 may have a generally cylindrical shape (other shapes are also possible). The second cavity 27 may join with the side cavity 32 extending from the side surface 14 of the housing 5. In some cases, the second cavity 27 may be the same as the side cavity 32. The first cavity 26 and the second cavity 27 may have their longitudinal axes parallel to each other. In some cases, the longitudinal axes of the first cavity 26 and the second cavity 27 may be collinear. The blind cavity 24 may receive and enclose the eyes 74, 76 of a hasp 70 and keeper 72 associated with a device to be locked by the locking device 100.

In this disclosure, the terms hasp 70 and keeper 72 are used to designate two members used to lock doors and the like, which have forward projecting apertured eyes 74, 76 adapted to be locked together, as by a padlock or a locking device 100. The hasp 70 and keeper 72 may be fastened to the door structure by plates, pads, or any other fastening device. The hasp 70 may be mounted on the door (or the movable portion) while the keeper 72 may be mounted on a frame (or the fixed portion), but such plates may be reversed, or may be used with two movable doors (such as a double door), or any other kind of door. When the doors are closed, the eyes 74, 76 of the hasp 70 and keeper 72 may project from the face of the door structure in a face-to-face parallel relationship. To lock the closed door, the locking device 100 may be placed on the door such that the back portion 12 of the locking device 100 may be parallel to the face of the door and the forward projecting portions of the hasp 70 and keeper 72 projects into the blind cavity 24 of the locking device 100. In this position, the eyes 74, 76 of the hasp 70 and keeper 72 may line up with both the first cavity 26 and the second cavity 27 in such a way that a straight shackle 44 inserted through the second cavity 27 may pass through the eyes 74 and 76 and into first cavity 26.

The back portion 12 of the locking device 100 may also have multiple pin slots 30 through which pins 28 may be inserted. A portion of the inserted pins 28 may pass through the first cavity 26 such that a cross-section of the first cavity 26 through the pins 28 reveal the circular cross-section of the first cavity 26 with the cross-section of each pin 28 occupying a segment of the circle on opposite sides. The portion of the pins 28 passing though the first cavity 26 may serve as locking flanges. As will be described in more detail below, the locking flanges formed by pins 28 in the first cavity 26 receive mating flanges of the shackle assembly 45 to lock the locking device 100.

The back portion 12 may also include a retaining hole 22 through which a retaining screw 20 passes. The retaining screw 20 may be threaded on its external surface. The internal surface of the retaining hole 22 may also be threaded to mate with threads on the retaining screw 20. The longitudinal axis of the retaining hole 22 may perpendicularly intersect the longitudinal axis of the side cavity 32 located on the side surface 14 of the housing 5. When the retaining screw 20 is screwed into the retaining hole 22, a portion of the retaining screw may protrude into the side cavity 32.

A sleeve 34 may be inserted into the side cavity 32 such that the longitudinal axis of the sleeve 34 is substantially collinear with the longitudinal axis of the side cavity 32. The sleeve 34 may have the shape of a hollow rectangular prism with rounded sides and parallel end surfaces—top surface 35 and bottom surface 37. The shape of the internal surface of the side cavity 32 may resemble the shape of the external surface of the sleeve 34, such that the external surface of the sleeve 34 and the internal surface of the side cavity 32 form curved mating surfaces. The term curved mating surfaces are used to refer to surfaces that, at any location, may be substantially parallel to each other. That is, the tangent at any point on one surface is substantially parallel to a tangent from the corresponding point of the other surface (for example, a hand and glove relation ship). A cross-section of the housing 5 along a plane perpendicular to the longitudinal axis of the side cavity 32 may reveal the sleeve 34 to have a rectangular cross-section with rounded sides circumscribed by the internal surface of the side cavity 32. The external dimensions of the sleeve 34 and the internal dimensions of the side cavity 32 may be such that the sleeve may be able to slide freely within the side cavity 32 without interference. It is also contemplated that portions of the external surface of the sleeve 34 may be in contact with the internal surface of the side cavity 32.

The sleeve 34 may also include an outer first surface 33 with a keyway 36. The keyway 36 may be a slot formed on the first surface 33 which extends part way through the thickness of the first surface 33. In some embodiments, the keyway 36 may extend through the entire thickness of the first surface 33. The keyway 36 may be formed on the center of the first surface 33 and may extend longitudinally over part of the length of the sleeve 34. The keyway 36 does not extend to the ends of the sleeve 34. When the sleeve 34 is inserted into the side cavity 32 of the housing 5 and the retaining screw 20 fastened to the retaining hole 22, the retaining screw 20 may extend into the keyway 36. The dimensions of the retaining screw 20 may be such that it permits the sleeve 34 to slide freely (travel) a certain distance within the side cavity 32 while preventing the sleeve 34 from being pulled out of the side cavity 32.

Figure 3:
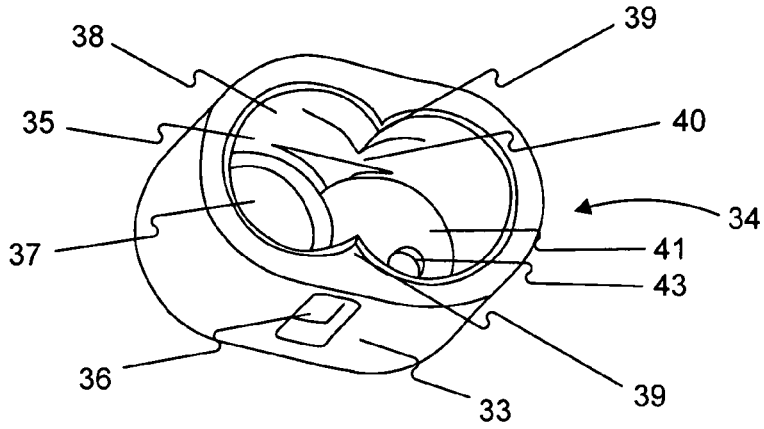
FIG. 3 is a pictorial illustration of the exemplary sleeve component of FIG. 2.

FIG. 3 shows a view of the sleeve 34 with its internal surfaces visible. In the description of the sleeve 32 that follows, reference will be made to both FIGS. 2 and 3. The cross-section (along a plane parallel to the top surface 35) of the internal surface of the sleeve 34 may reveal intersecting circles resembling a figure "8". With such a shape, the internal surface of the sleeve 34 may have curved and projecting surfaces 39. The projecting surfaces 39 may be opposite to each other and may protrude into the hollow internal cavity 38 of the sleeve 34. Proximate the top surface 35, one of the projecting surfaces 39 may be modified to form a locking flange surface 40. In some embodiments, the modification may involve machining one of the projecting surfaces 39 at a rearward portion of the sleeve 34 to remove the protruding portions in that area. In some embodiments, the locking flange surface 40 may extend into internal cavity 38 be substantially the entire length of the projecting surfaces 39. It is also contemplated that the length of the locking flange surface 40 may be more that or less than the length of the projecting surfaces 39. When the sleeve 34 is inserted into the side cavity 32, the top surface 35 of the sleeve 34 may be exposed and visible from the side surface 14 of the locking device 100. The bottom surface 37 of the sleeve 34, opposite to the top surface 35, may have a closure plate 41 that covers one lobe of the intersecting circle while leaving open the other lobe. The closure plate 41 may have a threaded hole 43 passing though it.

A shackle assembly 45 may include a shackle 44 having a substantially cylindrical shape. A rear end portion of the shackle 44 may include a pair of locking flanges 42. In some embodiments, the locking flanges 42 may be a machined feature on the shackle 44. It is also contemplated that the shackle 44 may be of another shape and the locking flanges 42 be formed by some other process, such as by fastening a separate locking flange section to the shackle 44. A forward end portion of the shackle 44 may include multiple fork holes 46. The fork holes 46 may be cavities formed on the forward end portion of the shackle 44, or may be formed on another part that is then attached to the forward end portion of the shackle 44. In some embodiments, two fork holes 46 may be formed on the forward end portion of the shackle 44. A fork retainer 52 may be attached to the fork holes 46 of the forward end portion of the shackle 44.

The fork retainer 52 may have the shape of two intersecting circles, resembling a figure "8," forming two lobes—a first lobe 51 and a second lobe 53. The fork retainer 52 may include forks 54 affixed to the second lobe 53 of the fork retainer 52. The forks 54 may include multiple forks 54 protruding from the fork retainer 52. In some embodiments, the forks 54 may be comprised of two forks 54 protruding away from the plane of the fork retainer 52, from both sides of the fork retainer 52. Although, the forks 54 may have any geometrical shape, in some embodiments, the forks 54 may have a substantially cylindrical shape and may be fixed to the fork retainer 52 such that the longitudinal axes of the forks 54 are substantially perpendicular to the planar area of the fork retainer 52. The first lobe 51 of the fork retainer 52 may include a threaded screw 47. To form the shackle assembly 45, the fork retainer 52 may be attached to the shackle 44 by inserting the forks 54 on one side of the fork retainer 52 into the fork holes 46 on the forward end portion of the shackle 44.

The shackle assembly 45 may be inserted into the hollow internal cavity of the sleeve 34 such that the shackle 44 protrudes out of the sleeve 34 through the exposed area on the bottom surface 37 of the sleeve 34. The threaded screw 47 may then be screwed into the threaded hole 43 on the closure plate 41 to secure the shackle assembly 45 to the sleeve 34. With the shackle assembly 45 attached to the sleeve 34, the shackle assembly 45 slides with the sleeve 34. The length of the keyway 36 on the sleeve 34 may determine the amount of permissible travel of the sleeve 32 and the shackle assembly 45. The lengths of the keyway 36 and the shackle 44 may be such that the locking flanges 42 on the rear end portion of the shackle 44 may travel the entire thickness of the blind cavity 24 and the depth of the first cavity 26.

Figure 4:
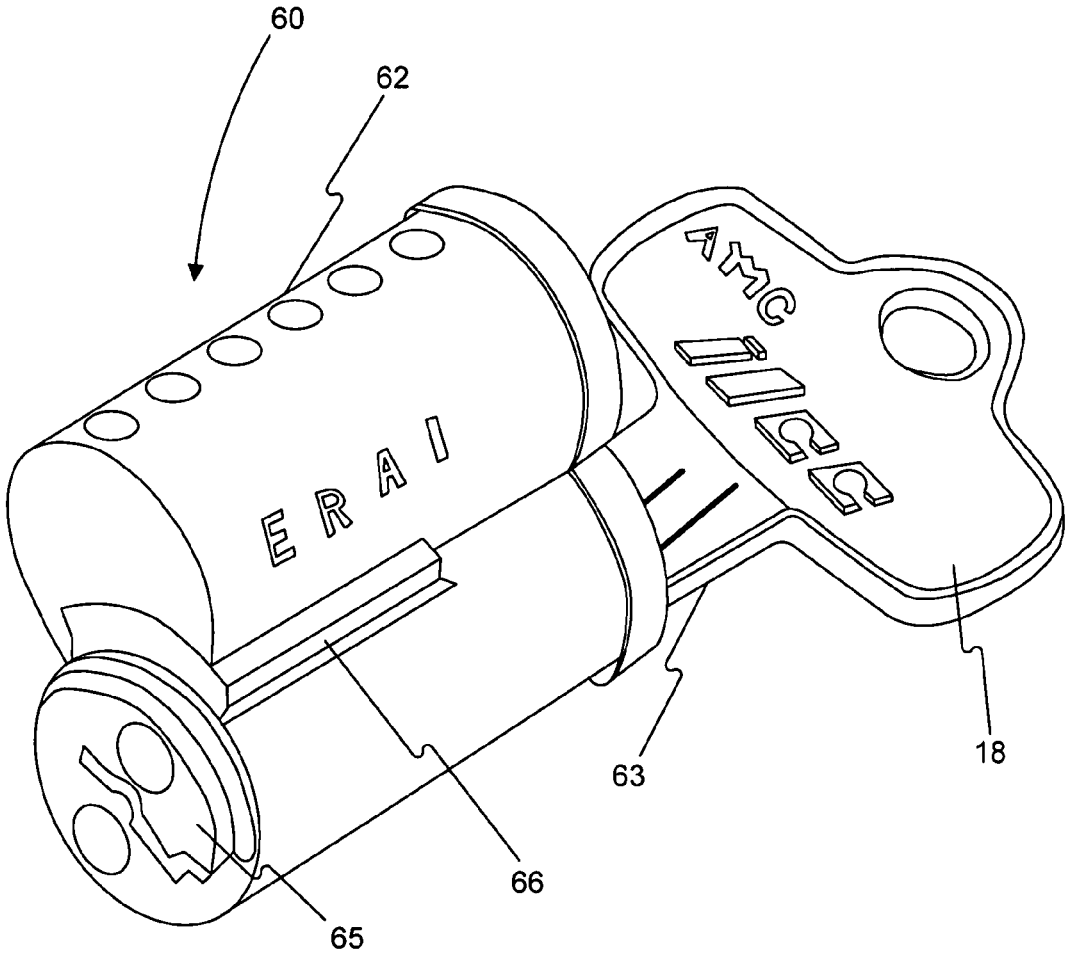
FIG. 4 is a pictorial illustration of the exemplary interchangeable core component of FIG. 2.

An interchangeable core 60 may be inserted into the hollow internal cavity 38 of the sleeve 34. FIG. 4 depicts the interchangeable core 60. In the description of the interchangeable core 60 that follows, reference will be made to both FIGS. 2 and 4. Since the interchangeable core 60 used in this disclosure is similar that those currently used with a commonly available padlock, it will not be described in great detail. The interchangeable core 60 may resemble two intersecting cylinders with their longitudinal axes parallel to each other. The cross-section of the interchangeable core 60 along a plane perpendicular to its longitudinal axis may resemble the figure "8". The external curved surface of the interchangeable core 60 and the internal curved surface of hollow internal cavity 38 may form mating surfaces. The interchangeable core 60 may also include two parallel surfaces, a first flat surface 63, and a second flat surface 65, as its end faces. The first flat surface 63 may include a key hole that accepts an operator key 16 and a control key 18. The second flat surface 65 may include holes (similar to fork holes 46) to mate with the forks 54 of the fork retainer 52. The curved external surface of the interchangeable core 60 may include a retaining tab 66. When the interchangeable core 60 is locked using the control key 18, notches on the side of the control key operate a set of locking pins (located in locking pin locking pin holes 62), and allow the interchangeable core 60 to turn. The operation of the locking pins in ensuring that only the correct key allows the interchangeable core 60 to turn is well known in the art and will not be described herein. When the interchangeable core 60 turns in one direction, the retaining tab 66 may protrude out of the curved surface of the interchangeable core 60 and engage with the locking flange surface 40 of the sleeve, thereby preventing the interchangeable core 60 from being pulled out. When the interchangeable core 60 is unlocked using the control key 18, the interchangeable core 60 turns in the opposite direction. When the interchangeable core 60 turns in the opposite direction, the retaining tab 66 retracts and disengages from the locking flange surface 40 allowing the interchangeable core 60 to be pulled out of the sleeve 34.

With the interchangeable core 60 locked (lockingly disposed) within the sleeve, the operator key 16 may be used to operate the locking device 100. When the operator key 16 is used to lock the locking device 100, notches on the side of the operator key operate a second set of locking pins, and allow the interchangeable core 60 and the shackle 44 to rotate. When the shackle 44 rotates, the locking feature 42 at the end of the shackle 44 also rotates and engages with the pins 28 that protrude within the first cavity 26, thereby locking the locking device 100. When the operator key 16 is used to unlock the locking device 100, the shackle 44 turns in the opposite direction allowing the locking feature 42 to disengage from the pins 28, thereby allowing the shackle 44 to be retracted from the first cavity and the blind cavity 24.

It should be emphasized that although the interchangeable core 60 is described as resembling two intersecting cylinders having a figure "8" cross-section, interchangeable cores having a different configuration can also be used. If an interchangeable core 60 having a different configuration is used, the cross-sectional shape of the internal cavity 38 of the sleeve 34 may also change to match the cross-sectional shape of the interchangeable core 60. That is, the external curved surface of the interchangeable core 60 and the internal curved surface of hollow internal cavity 38 may maintain their mating surfaces relationship.

INDUSTRIAL APPLICATION

The disclosed locking device 100 retains the advantages of conventional padlocks while incorporating the interchangeable core concept of commonly used padlocks. A conventional hockey puck lock is modified to include a hollow sleeve 34 to interface with the interchangeable core 60 and the housing 5 of the locking device 100. A cylindrical shackle 44 is also rigidly attached to the sleeve 34 with their longitudinal axes parallel to each other. The sleeve 34 is slidably disposed on the housing 5 of the locking device 100, and is secured to the housing 5 using a retaining screw 20. The retaining screw 20 permits the sleeve 34 and the shackle 44 to freely slide in the housing 5, while preventing them from being detached from the housing 5. The sleeve 34 along with the attached shackle 44 slides in the direction of their longitudinal axes. The interchangeable core 60 slides into the internal cavity 38 of the sleeve 34, mates with the shackle 44, and is locked in place using the threaded screw 47. A retaining tab 66 that protrudes from the external curved surface of the interchangeable core 60 engages with a feature (locking flange surface 40) formed on the internal cavity 38 of the sleeve 34 to lock the interchangeable core 60 in the sleeve 34. In the locked position, the interchangeable core 60 slides with the sleeve 34 without relative motion between them. When an operator key 18 is inserted into the interchangeable core and turned, notches on the side of the operator key 18 operate locking pins and allow the interchangeable core 60 along with the shackle to turn. When the shackle turns, locking flanges 42 formed on the rear end portion of the shackle 44 engage with mating flanges in the housing (pins 28 within the first cavity 26), thereby locking the shackle 44 to the housing. When a control key 18 is inserted into the interchangeable core 60 and turned, the retaining tab 66 disengages from the feature (locking flange surface 40) formed on the internal cavity 38 of the sleeve 34, allowing the interchangeable core 60 to be slid out of the sleeve 34. The operation of the locking device will now be described.

The doors to be locked using the locking device is closed such that the hasp 70 mounted on the door and the keeper 72 mounted on a frame beside the door project outwards from the face of the door structure in a face-to-face parallel relationship. In this orientation, the eyes 74, 76 of the hasp 70 and the keeper 72 may be in line with each other. That is, the longitudinal axis of the eyes 74, 76 may be substantially collinear.

The locking device 100 may be placed on the door such that the back portion 12 of the locking device 100 may be flush with the face of the door, with the forward projecting portions of the hasp 70 and keeper 72 projecting into the blind cavity 24 of the locking device 100. In this position, the eyes 74, 76 of the hasp 70 and keeper 72 may line up with the first cavity 26 and the second cavity 27 of the locking device 100. The sleeve 34 (along with the attached shackle assembly 45 and the interchangeable core 60) may be pushed into the side cavity 32 such that the top surface 35 of the sleeve is closest to the side surface 14 of the housing 5. In this position, the shackle 44 passes through the eyes 74, 76 of the hasp 70 and keeper 72, and into the first cavity 26. The operator key 16 may then be inserted into the key hole on the first flat surface 63 of the interchangeable core 60 and turned. If the correct key is used, one of the cylinders of the interchangeable core 60 rotates, rotating the shackle 44 along with it. When the shackle 44 rotates, the locking flanges 42 at the end of the shackle engages with the pins 28 within the first cavity 26. When the locking feature 42 engages with the pins 28, the shackle 44 is prevented from being pulled out of the first cavity 26, thereby locking the hasp 70 and keeper 72 together.

If the operator key 16 is misplaced, the control key 18 may be used to unlock the interchangeable core 60 from the housing, thereby allowing it to be replaced with another interchangeable core 60 with another set of keys. To unlock the integrated core 60, the control key 18 is inserted into the key hole on the first flat surface 63 of the interchangeable core 60 and turned. If the correct key is used, one of the cylinders of the interchangeable core 60 rotates, disengaging the retaining tab 66 from the locking flange surface 40 allowing the interchangeable core 60 to be pulled out of the sleeve 34. A new interchangeable core 60 may now be inserted and its control key 18 used to lock the interchangeable core 60 into the housing 5 of the locking device 100. Since the interchangeable core 60 may only be removed form the locking device 100 using the control key 18, unauthorized removal of the core may be prevented. The removal of the interchangeable core 60 using a control key 18 also allows replacement of the core without compromising the effectiveness of the locking device 100.

It will be apparent to those skilled in the art that various modifications and variations can be made to the disclosed hidden shackle style lock. Other embodiments will be apparent to those skilled in the art from consideration of the specification and practice of the hidden shackle style lock with an interchangeable core. It is intended that the specification and examples be considered as exemplary only, with a true scope being indicated by the following claims and their equivalents.

What is claimed is:

1. A hidden shackle style lock comprising;

a substantially cylindrical housing having a top surface, a bottom surface, and a curved side surface;

a first cavity on the bottom surface of the housing extending part way along a thickness of the housing;

a second cavity on the side surface intersecting with the first cavity;

a hollow sleeve slidably attached within the second cavity, the sleeve including a first end face, a second end face, and a third cavity, the third cavity extending from the first end face to the second face and being substantially coaxial with the second cavity;

a shackle having a first end and a second end fixedly coupled to the first end face of the sleeve; and an interchangeable core having a first locking mechanism and a second locking mechanism lockingly disposed within the third cavity and coupled to the straight shackle, the interchangeable core being configured to, operate the first locking mechanism to rotate the shackle, and operate the second locking mechanism to unlock the interchangeable core from the third cavity.

2. The hidden shackle style lock of claim 1, including an end piece attached to the first end face of the sleeve, the end piece further including, a first set of substantially parallel pins on one side of the end piece and a second set of substantially parallel pins on an opposite side of the end piece, the shackle being coupled to the end piece using the first set of pins and the interchangeable core coupled to the end piece using the second set of pins.

3. The hidden shackle style lock of claim 1 wherein the sleeve is configured to slide within the second cavity from a first position to a second position, the first position being a position where the first end face is proximate to the curved side surface, and the second position being a position where the second end face is proximate to the curved side surface.

4. The hidden shackle style lock of claim 1 further including:

a fourth cavity on a side wall of the first cavity, the fourth cavity being substantially coaxial with the second cavity, and one or more first locking features within the fourth cavity.

5. The hidden shackle style lock of claim 4, wherein the first end of the shackle is coupled to the sleeve and the second end includes first locking flanges.

6. The hidden shackle style lock of claim 5, wherein operating the first locking mechanism engages the first locking flanges with the first locking features.

7. The hidden shackle style lock of claim 1 further including:

second locking feature formed on a surface of the third cavity, and second locking flange on an external surface of the interchangeable core.

8. The hidden shackle style lock of claim 7, wherein operating the second locking mechanism moves the second locking flange from a third position to a fourth position, the third position being a position where the second locking flange is substantially flush with the external surface of the interchangeable core, and the fourth position being a position where the second locking flange protrudes from the external surface.

9. The hidden shackle style lock of claim 7, wherein operating the second locking mechanism engages the second locking flange with the second locking feature.

10. The hidden shackle style lock of claim 1, wherein the sleeve includes a curved face between the first end face and the second end face, the curved surface further including a longitudinal key way substantially centrally located between the first end face and the second end face.

11. The hidden shackle style lock of claim 10 wherein the sleeve is slidably attached within the second cavity by a screw attached to the housing protruding into the key way, and a distance of sliding of the sleeve is substantially equal to a length of the key way.

12. The hidden shackle style lock of claim 1, wherein the first locking mechanism is configured to operate with a first key having a first blade shape, and the second locking mechanism is configured to operate with a second key having a second blade shape different than the first blade shape.

13. The method of using a hidden shackle style lock with an interchangeable core comprising;

slidably attaching a hollow sleeve within a first cavity of a housing of the lock;

fixedly coupling a shackle having a first locking feature to the sleeve;

inserting an interchangeable core including a first locking mechanism and a second locking mechanism within a central cavity of the hollow sleeve;

operating the first locking mechanism to lockably attach the interchangeable core to the sleeve;

sliding the shackle across an exposed second cavity; and operating the second locking mechanism to engage the first locking feature.

14. The method of claim 13, wherein inserting the interchangeable core includes coupling the interchangeable core to the shackle.

15. The method of claim 13, wherein operating the second locking mechanism includes rotating the shackle to engage the first locking feature.

16. The method of claim 13, wherein operating the first locking mechanism includes engaging a second locking feature on an external surface of the interchangeable core with mating features on a surface of the central cavity.

17. The method of claim 13, wherein operating the first locking mechanism includes using a first key having a first blade shape, and operating the second locking mechanism includes using a second key having a second blade shape different than the first blade shape.

18. A locking device comprising;

a housing including a first cavity and a second cavity, the first cavity perpendicularly intersecting the second cavity;

a hollow sleeve slidably disposed within the second cavity, the sleeve including a third cavity substantially coaxial with the second cavity;

a shackle fixedly coupled to the sleeve such that the shackle is configured to slide across the first cavity; and an interchangeable core lockingly disposed within the third cavity and coupled to the shackle, the interchangeable core being lockingly disposed by operating a first locking mechanism of the interchangeable core using a key.

19. The lock of claim 18, wherein the sleeve includes a longitudinal slot on an external surface thereof, the sleeve being slidably disposed on the housing by a feature attached to the housing protruding into the longitudinal slot.

20. The lock of claim 18, wherein the third cavity and the interchangeable core both have a cross-sectional shape resembling a figure "8".

21. The lock of claim 18, including a fourth cavity on a surface of the first cavity, the fourth cavity being substantially coaxial to the second cavity and including locking features.

22. The lock of claim 18, wherein operating a second locking mechanism of the interchangeable core rotates the shackle and engages the locking features.

23. The lock of claim 18, wherein the interchangeable core further includes a second locking mechanism that is operable to rotate the shackle when the second locking mechanism is operated using a second key having a blade shape different that a blade shape of the key operating the first locking mechanism.

* * * * *